US005560451A

United States Patent [19]

Hincks

[11] Patent Number: 5,560,451

[45] Date of Patent: Oct. 1, 1996

[54] FORKLIFT VEHICLES

[75] Inventor: Alan J. Hincks, Benoni, South Africa

[73] Assignee: Venture U.S.A. Incorporated, High Point, N.C.

[21] Appl. No.: 341,626

[22] Filed: Nov. 17, 1994

[30] Foreign Application Priority Data

Nov. 18, 1993 [ZA] South Africa ..... 93/8621

[51] Int. Cl.[6] ..... B66F 9/12

[52] U.S. Cl. ..... 187/237; 187/222; 414/785; 293/121

[58] Field of Search ..... 187/222, 237; 414/785; 293/121; 267/139, 140

[56] References Cited

U.S. PATENT DOCUMENTS

| | | | |
|---|---|---|---|
| 2,574,045 | 11/1951 | Lapham | 414/785 X |
| 3,179,397 | 4/1965 | Cleereman et al. | 267/140 |
| 3,197,189 | 7/1965 | Pemper et al. | 267/140 |
| 3,418,815 | 12/1968 | Kumazawa | 267/140 X |
| 3,625,385 | 12/1971 | Ide | 187/237 X |
| 4,102,464 | 7/1978 | Schuster | 214/750 |
| 4,395,190 | 6/1983 | Barchard | 414/785 X |
| 4,538,953 | 9/1985 | Abramson, Jr. | 414/785 X |

FOREIGN PATENT DOCUMENTS

| | | |
|---|---|---|
| 913407 | 2/1992 | South Africa . |
| 1641767 | 4/1991 | U.S.S.R. . |

OTHER PUBLICATIONS

Little Giant Products, Inc. information brochure entitled "the big rip–off continues . . . " (no date).

Little Giant Products, Inc. Pallet Saver Parts & Services manual, the section entitled "Installation Instructions" (1978).

Extract from a Little Giant Products, Inc. information brochure entitled "Simple Installation" (1978).

Little Giant Products, Inc. information brochure entitled "Pallet Saver Attachment" (no date).

Little Giant Products, Inc. information brochure entilted "Pallet Saver Assembly" [class 1 (Model PS 55) and class 11 (Model PS 100)], no date.

Paper prepared by F. C. Schuster, V. P. Engineering, Little Giant Product, Inc. entitled "Pallet Saver 'The Missing Link' with extract from an article reprinted from Purchasing World (Nov. 1976 issue, p. 108) entitled Wooden Pallet Damage—A Sequel".

Extract from an article by J. R. Reves of the Canadian Forestry Service entitled "Simple Fork Device Protects Pallets from Lift Truck Damage" (no date).

Extract from an article reprinted from Materials Management and Distribution (Jan. 1975) a section which is entitled "Stringers Protected".

*Primary Examiner*—William E. Terrell
*Assistant Examiner*—Dean A. Reichard
*Attorney, Agent, or Firm*—DeLio & Peterson

[57] ABSTRACT

The invention is concerned with forklift vehicle and in particular with a shock absorber device for use with such vehicles to reduce the severity of damage caused to pallets by the forklift vehicle. In accordance with the invention, the forklift vehicle has a conventional post structure with a carriage structure movable up and down the post structure. The carriage structure includes vertically spaced, horizontally extending carriage beams to which the forks of the vehicle are attached. The shock absorber device has an elongate shock absorbing body and a backing plate on which the shock absorbing body is mounted. The backing plate is connected to and supported only by the lowest carriage beam with no attachment between the backing plate and any upper carriage beam. The shock absorbing body extends horizontally across and in front of the lowest carriage beam, between the forks, in a position to impact upon the internal cross-bearers of a pallet. Reaction forces arising from impacts are taken by the lowest carriage beam without any substantial turning moment being applied to the carriage structure. This reduces the risk of the shock absorber device working itself free.

25 Claims, 2 Drawing Sheets

FORKLIFT VEHICLES

BACKGROUND TO THE INVENTION

THIS invention relates to a forklift vehicle and to a shock absorber device for a forklift vehicle.

Forklift vehicles are commonly used to handle wooden pallets on which goods are stacked. Such vehicles usually have a pair of forks which are L-shaped with upright portions and forwardly projecting tines. In practice, the vehicle is driven such that the tines enter the pallet, between upper and lower decks thereof. The tines are fully inserted when the upright portions of the forks abut the upper deck of the pallet.

A problem which arises is damage to the upper deck of the pallet if the forklift vehicle approaches the pallet too fast and the impact between the upright portions of the forks and the upper deck of the pallet is too severe. In such situations, it is quite common for the leading edge of the upper deck to suffer considerable impact damage or for this deck to be ripped off entirely. A similar problem arises if, having picked up a pallet, the driver of the vehicle drives too fast to an off-loading destination and causes the pallet to impact against a formerly deposited pallet or against another obstacle. In each case, the upper deck of the pallet can be destroyed extremely rapidly to the extent that the pallet becomes unserviceable and replacement thereof is necessary.

U.S. Pat. No. 4,102,464 to Schuster addresses the aforementioned problems to some extent. Schuster proposes a shock absorbing device which is intended to impact on a cross-bearer of the pallet structure before the upright portions of the forks impact against the upper deck of the pallet. Schuster's shock absorbing device comprises a solid rubber cushioning member fixed to a bracket. The bracket is attached, in a readily movable manner, to the upper and lower carriage or cross beams of the forklift vehicle with the rubber cushioning member extending below the lower carriage beam.

While the Schuster shock absorbing device has the advantage that at least a part of the impact is transferred directly to the cross-bearer rather than to the leading edge of the upper pallet deck, it has the problem that when the device impacts against a pallet, the reaction force on the device applies a moment to the device which tends to disconnect the device from the supporting carriage beams. After a few impacts only the device may work loose and thereafter be unable to perform a proper shock absorbing function.

SUMMARY OF THE INVENTION

According to the present invention there is provided a forklift vehicle comprising:

a post structure, a carriage structure movable up and down the post structure, the carriage structure including vertically spaced, horizontally extending carriage beams, transversely spaced forks supported by the carriage beams of the carriage structure, each fork having an upright portion and a forwardly extending tine, and a shock absorber device including an elongate shock absorbing body and a backing plate on which the shock absorbing body is mounted, the backing plate being connected to and supported only by the lowest carriage beam and there being no attachment between the backing plate and any upper carriage beam, the arrangement being such that the shock absorbing body extends horizontally across and in front of the lowest carriage beam, between the forks, in a position to impact upon an internal cross-bearer of a pallet, reaction forces arising from impacts and transmitted by the shock absorbing body being taken by the lowest carriage beam without any substantial turning moment being applied to the carriage structure.

In the case of a pallet which has multiple internal cross-bearers, the shock absorbing body is preferably of sufficient length to impact simultaneously on all of the internal cross-bearers.

The backing plate is conveniently bolted or welded directly to the lowest carriage beam at the centre of the lowest carriage beam.

The shock absorbing body may be of an elastomeric material, typically rubber, and is preferably of hollow construction. The shock absorbing body may comprise a series of segments arranged end to end with one another to form the full length of the body. The segments may be replaceable independently of one another. In some embodiments, some segments may be made of elastomeric material which is of different resilience to the elastomeric material of which other segments are made.

According to another aspect of the invention there is provided a shock absorber device for a forklift vehicle comprising a post structure, a carriage structure movable up and down the post structure, the carriage structure including at least one horizontally extending carriage beam and transversely spaced forks supported by the carriage structure, the shock absorber device comprising:

an elongate, hollow shock absorbing body, and backing plate on which the shock absorbing body is mounted, wherein the backing plate is adapted for connection to the lowest carriage beam or to the upright portions of the forks, with no attachment between the backing plate and any upper carriage beam located above the lowest carriage beam, the connection being such that the shock absorbing body extends horizontally in front of the lowest carriage beam, between the forks, in a position to impact upon an internal cross-bearer of a pallet, and the connection also being such that reaction forces arising from such impact are taken by the lowest carriage beam without any substantial turning moment being applied to the carriage structure.

BRIEF DESCRIPTION OF THE DRAWINGS

The invention will now be described in more detail, by way of example only, with reference to the accompanying drawings in which.

DESCRIPTION OF EMBODIMENTS

Figure 1:
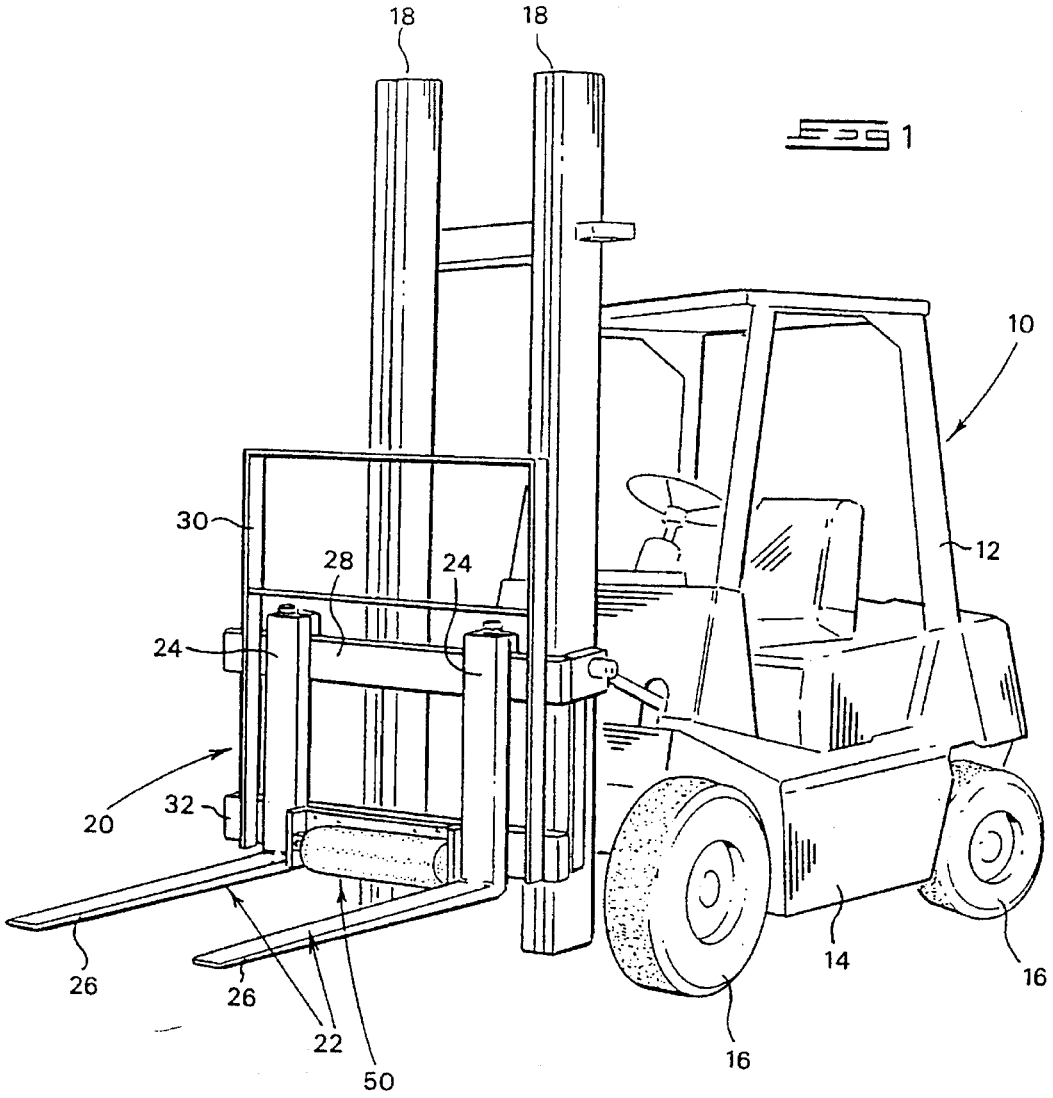
FIG. 1 shows a perspective view of a forklift vehicle of the invention.
Figure 2:
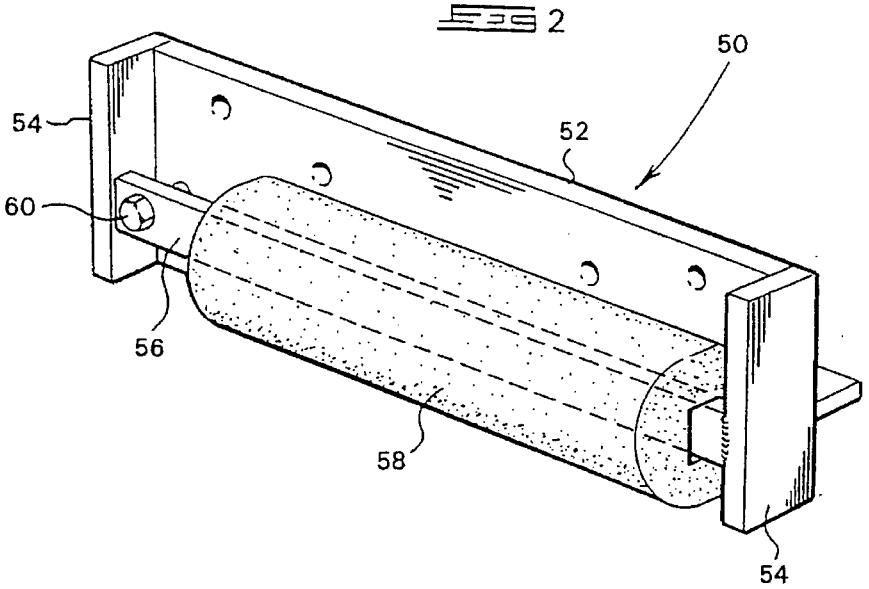
FIG. 2 shows a perspective view of the shock absorber device used in the vehicle of FIG. 1.

FIG. 1 shows a forklift vehicle 10 which has a driver's cab 12, a chassis 14, wheels 16, a post structure which includes spaced vertical posts 18 at the front end of the chassis, a carriage structure 20 mounted on the posts for movement up and down the posts, and a pair of forks 22.

Each of the forks 22 is L-shaped with an upright portion 24 and a forwardly extending tine 26 as illustrated. The carriage structure includes vertically spaced, horizontal carriage beams 28 and 32. The upper ends of the portions 24 of the forks are supported on the uppermost carriage beam 28 while the lower ends of the portions 24 are supported by the lowest carriage beam 32.

Figure 6:
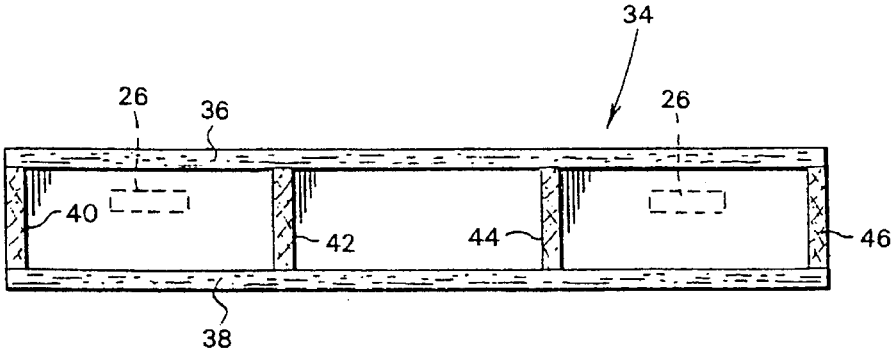
FIG. 6 shows an end view of a typical pallet.

In practice, the lateral positions of the forks 22 on the carriage beams 28 and 32 are adjustable to suit different pallets which the forklift vehicle 10 may be called upon to handle. In the present case, the forks 22 are set in positions to handle a pallet 34 such as that seen in end view in FIG. 6. The pallet 34 has upper and lower decks 36 and 38 respectively, outer cross-bearers 40 and 46 and two internal cross-bearers 42 and 44. The decks and cross-bearers are composed of timber planks which are nailed together. A pallet such as that seen in FIG. 6 is typically used to support stacked beverage crates or the like, with the forklift vehicle 10 then being used to move the stacked crates from one position to another on their pallets.

As thus far described, the forklift vehicle 10 and pallet 34 are largely conventional. What is not conventional about the vehicle 10 is the provision of a shock absorber device indicated generally by the numeral 50 in FIG. 1 and seen in more detail in FIGS. 2 to 5. Referring to these Figures, the device 50 has a rectangular steel backing plate 52 with flanges 54 at either end. One end of a slender steel bar 56 is welded to one of the flanges 54. The bar 56 passes lengthways through an elongate D-rubber 58, and the opposite end of the bar is holed to take a bolt 60 which threads into a tapped hole in the backing plate 52.

Figure 4:
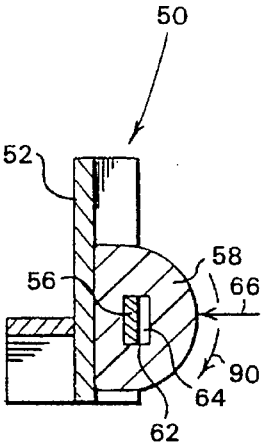
FIG. 4 shows a cross-section at the line 4—4 in FIG. 3.

The D-rubber 58 has a hollow D-shape in cross-section, as will be particularly clear from FIG. 4. The bar 56 passes through the internal hollow 62 of the D-rubber, leaving a vacant space 64 as illustrated. It will be appreciated that the D-rubber has a considerable degree of resilience, resulting from the inherent resilience of the rubber itself and the vacant space 64, when subjected to impact forces in the direction of the arrow 66 in FIG. 4.

The backing plate 52 is formed with four holes 68 in positions corresponding to tapped holes formed in the carriage beam 32. The backing plate is connected directly to the carriage beam 32 by means of suitable bolts passing through the holes 68 and engaging in the tapped holes. In an alternative mounting system, the backing plate 52 is welded directly to the beam 34. In either case, the backing plate is arranged centrally on the carriage beam 32 and is incapable of sideways or other movement relative to the beam.

Referring to FIG. 1, it will be seen that the shock absorber device is positioned between the forks 22 with the D-rubber extending horizontally. The forward extremity of the D-rubber is in advance of the front surfaces of the upright portions 24 of the forks 22.

In practice, the location of the D-rubber is such that it will impact on the ends of the internal cross-bearers 42 and 44 of the pallet 34 when the vehicle 10 is driven towards the pallet and the tines 26 of the forks 22 are inserted between the upper and lower pallet decks 36 and 38 at the positions depicted in broken outline in FIG. 6.

It will be recognised that timber is better able to take impact loads imposed on it in the direction of its grain than in a direction transverse to the grain. Accordingly it is believed that impacts applied to the ends of the cross-bearers 42 and 44, as described above, will be less harmful to the pallet than the impacts applied conventionally to the upper deck 36 by the upright portions of the forks 22. Damage to the pallet is further reduced by the use of a hollow D-rubber which is able to deform resiliently to a large degree to perform the necessary shock-absorbing function.

In the illustrated embodiment, the length of the D-rubber 58 is sufficient for it to impact simultaneously on both of the internal cross-bearers 42 and 44. In cases where there is only a single internal cross-bearer (not illustrated), it would be possible for the D-rubber to be made correspondingly shorter. However, it is preferred to use a D-rubber of substantial length because in practice the D-rubber will also impact to some extent on the leading edge of the upper deck 36 and possibly also on the leading edge of the lower deck 38 of the pallet. With a D-rubber of substantial length, the impact force is distributed over a greater length and hence there is less likelihood of serious damage to the leading edge of the upper deck of the pallet.

Approximately the same zones along the length of the D-rubber will normally impact the ends of the cross-bearers 42 and 44 when similar pallets are being handled. Accordingly those zones of the D-rubber will be subject to the most rapid wear. When wear in these regions becomes unacceptable, the D-rubber is replaced.

This is achieved by disengaging the bolt 60 from the backing plate 52. The bar 56 is then flexed away from the backing plate and the worn D-rubber 58 is slipped lengthways off the bar. After a new D-rubber has been slipped over the bar into the correct longitudinal position, the bolt 60 is again engaged with the backing plate 52 to secure the D-rubber in place.

Figure 3:
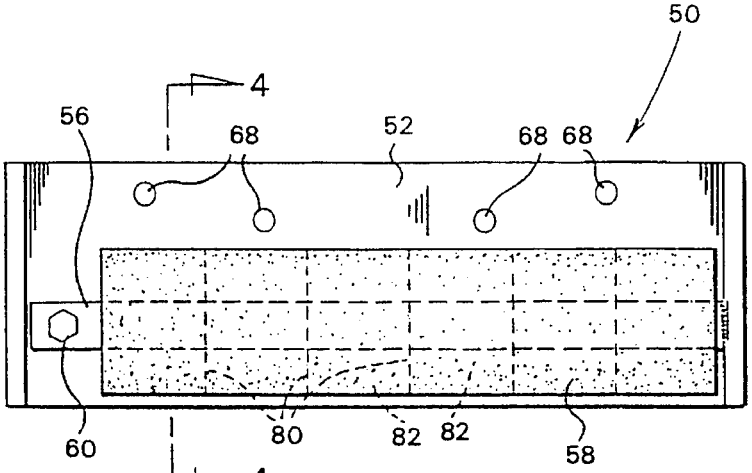
FIG. 3 shows a front elevation of the shock absorber device.

In a preferred embodiment, illustrated by broken lines 80 in FIG. 3, the D-rubber may be composed of a series of discrete segments 82 arranged end-to-end. With this arrangement, those segments which undergo the most rapid wear as a result of repeated impacts with pallets 34 can be replaced by unworn segments. Thus it would be possible to remove the segments from the bar and then re-thread them onto the bar in different relative positions, so that previously unworn segments are now positioned to receive the bulk of the impacts. In this way, it is expected that the life of the D-rubber, as a whole, can be prolonged. Alternatively of course, the worn segments can be replaced by completely new segments.

The invention also contemplates an arrangement in which different segments 82 of the D-rubber are made of rubber or other elastomeric material of different stiffnesses. Thus those segments which are positioned to take the most severe impacts from the cross-bearers may be made of a material which is more robust and of greater stiffness than the other segments. In each case it will be possible to custom-design the D-rubber to suit the particular type and size of pallet which is to be handled.

Figure 5:
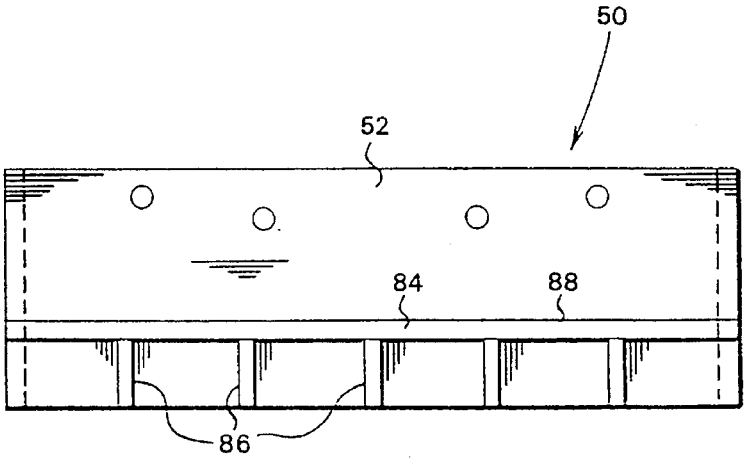
FIG. 5 shows a rear elevation of the shock absorber device.

Referring to FIG. 5 it will be seen that the rear surface of the backing plate is reinforced by a longitudinally extending flat bar 84 and a series of transverse gussets 86. In practice the backing plate is connected to the carriage beam 32 with the upper surface 88 of the bar 84 abutting the lower edge of the beam 32. The bar 84 assists in positioning the D-rubber at the correct elevation to impact against the cross-bearer(s) of the pallet.

When compared to the teachings of Schuster (US patent 4,102, 464), the embodiment described above has several advantages. Most importantly, it will be noted that there is no attachment between the D-rubber or its backing plate 52 to the upper carriage beam 28. In order to make the correct impact with the cross-bearer(s), the D-rubber extends slightly below the carriage beam 32, as will be dear from FIG. 4. When an impact takes place, the majority of the transmitted force transmitted by the D-rubber will be taken face-on by the carriage beam 32. There will however also be an element of the transmitted force tending to apply a turning moment as illustrated by the arrow 90 in FIG. 4. The firm bolted or welded fixture of the backing plate to the carriage beam is quite capable of resisting such turning moments.

In Schuster's case, where the bracket supporting the cushioning element is suspended from both the upper and lower carriage beams, the effect of the turning moment is greatly increased at the point of suspension from the upper carriage beam, with the result that the bracket is rapidly loosened. In the present case, there is far less likelihood of the backing plate coming loose from the carriage beam 32.

This likelihood is reduced further by the provision of the bar 84 which locates snugly beneath the lower edge of the beam 32. In an alternative design, the bar 84 and gussets 86 could be replaced by a single length of angle iron welded to the rear surface of the backing plate.

Thus the absence of any attachment of the backing plate to the upper carriage beam 28 is considered to be a major advantage of the invention.

Another advantage of the present embodiment over the Schuster arrangement is the use of a hollow rubber as the shock absorbing body instead of Schuster' solid rubber pad. The hollow nature of the D-rubber gives it substantially more resilience, and hence a greater ability to absorb reaction forces arising from impacts with pallets, than a solid rubber element. this in turn imposes less stress on the driver of the forklift vehicle.

A further advantage of connecting the backing plate to the lowest carriage plate only is the fact that it is then not necessary to take account of different spacings between the upper and lower carriage beams in different forklift vehicles.

As described above, replacement of the D-rubber, or D-rubber segments, is achieved by loosening the bolt 60 and slipping the rubber or segments lengthways off the bar 56. In some cases, where the D-rubber is subjected to unusually heavy impacts, with the possibility that the bolt 60 may inadvertently come loose during normal operation, the end of the bar 56 may be fixed, as by welding, to a suitable lug or other projection on the backing plate 52.

In this case, replacement of the D-rubber or segments will necessitate cutting of the weld to free the end the bar and permit removal of the old components therefrom.

In the illustrated embodiment, there are upper and lower carriage beams 28 and 32. Some forklift vehicles only have a single carriage beam, typically of considerable vertical height. In this case, the sole carriage beams acts as the lowest carriage beam, with the backing plate 52 being connected to this beam at a low elevation.

Also, in the illustrated embodiment, the shock absorber device 50 is connected to the lowest carriage beam. This allows the forks 22 to be moved towards or apart from one another to suit pallets of different size or design. In cases where the forklift vehicle will only be called upon to handle pallets of one clearly defined size, there is no need to adjust the positions of the forks relative to one another. In such cases, it would be possible to connect the shock absorber device to the front surfaces of the lower ends of the upright portions of the forks, for instance by welding, rather than to the lower carriage beam.

The invention also contemplates a version in which, in addition to the illustrated horizontal D-rubber, there are two or more vertical D-rubbers suitably mounted and positioned on the carriage structure to impact on the pallet and/or on goods stacked on the pallet.

I claim:

1. A forklift vehicle comprising:

a post structure, a carriage structure movable up and down the post structure, the carriage structure including at least one horizontally extending carriage beam, transversely spaced forks supported by the carriage structure, each fork having an upright portion and a forwardly extending fine, and a shock absorber device including an elongate shock absorbing body and a backing plate on which the shock absorbing body is rigidly mounted, the backing plate being connected to and supported only by the lowest carriage beam or by the upright portions of the forks, there being no attachment between the backing plate and any upper carriage beam located above the lowest carriage beam, the arrangement being such that the shock absorbing body extends horizontally in front of the lowest carriage beam, between the forks, in a position to impact upon an internal cross-bearer of a pallet, reaction forces arising from such impact and transmitted by the shock absorbing body being taken by the lowest carriage beam without any substantial turning moment being applied to the carriage structure.

2. A forklift vehicle according to claim 1 wherein the shock absorbing body is of sufficient length to impact simultaneously on all of the internal cross-bearers of a pallet having multiple internal cross-bearers.

3. A forklift vehicle according to claim 1 wherein the backing plate is bolted directly to the lowest carriage beam at the centre of the lowest carriage beam.

4. A forklift vehicle according to claim 1 wherein the backing plate is welded directly to the lowest carriage beam at the centre of the lowest carriage beam.

5. A forklift vehicle comprising:

a post structure, a carriage structure movable up and down the post structure, the carriage structure including at least one horizontally extending carriage beam, transversely spaced forks supported by the carriage structure, each fork having an upright portion and a forwardly extending fine, and a shock absorber device including an elongate shock absorbing body, wherein the shock absorbing body is made of an elastomeric material and is of hollow construction, and a backing plate on which the shock absorbing body is mounted, the backing plate being connected to and supported only by the lowest carriage beam or by the upright portions of the forks, there being no attachment between the backing plate and any upper carriage beam located above the lowest carriage beam, the arrangement being such that the shock absorbing body extends horizontally in front of the lowest carriage beam, between the forks, in a position to impact upon an internal cross-bearer of a pallet, reaction forces arising from such impact and transmitted by the shock absorbing body being taken by the lowest carriage beam without any substantial turning moment being applied to the carriage structure.

6. A forklift vehicle according to claim 5 wherein the shock absorbing body is provided by a D-rubber.

7. A forklift vehicle according to claim 6 wherein the shock absorbing body comprises a series of segments arranged end to end with one another to form the full length of the body.

8. A forklift vehicle according to claim 7 wherein the segments are replaceable independently of one another.

9. A forklift vehicle according to claim 8 wherein some segments are made of elastomeric material which is of different stiffness to the elastomeric material of which other segments are made.

10. A forklift vehicle according to claim 5 wherein the shock-absorbing body is threaded onto a bar mounted on the backing plate.

11. A shock absorber device for a forklift vehicle comprising a post structure, a carriage structure movable up and down the post structure, the carriage structure including at least one horizontally extending carriage beam and transversely spaced forks supported by the carriage structure, the shock absorber device comprising:

an elongate, hollow shock absorbing body made of elastomeric material, and a backing plate on which the shock absorbing body is mounted, wherein the backing plate is adapted for connection to the lowest carriage beam or to the upright portions of the forks, with no attachment between the backing plate and any upper carriage beam located above the lowest carriage beam, the connection being such that the shock absorbing body extends horizontally in use in front of the lowest carriage beam, between the forks, in a position to impact upon an internal cross-bearer of a pallet, and the connection furthermore being such that reaction forces arising from such impact are taken by the lowest carriage beam without any substantial turning moment being applied to the carriage structure of the forklift vehicle.

12. A shock absorber device according to claim 11 wherein the shock absorbing body is of sufficient length to impact simultaneously on all of the internal cross-bearers of a pallet having multiple internal cross-bearers.

13. A shock absorber device according to claim 11 wherein the backing plate is formed with a series of holes to take bolts serving to bolt the backing plate directly to the lowest carriage beam.

14. A shock absorber device according to any one of claim 11 wherein the shock absorbing body is provided by a D-rubber.

15. A shock absorber device according to claim 14 wherein the shock absorbing body comprises a series of segments arranged end to end with one another to form the full length of the body.

16. A shock absorber device according to claim 15 wherein the segments are replaceable independently of one another.

17. A shock absorber device according to claim 16 wherein some segments are made of elastomeric material which is of different stiffness to the elastomeric material of which other segments are made.

18. A shock absorber device according to claim 14 wherein the shock-absorbing body is of hollow construction and is threaded onto a bar mounted on the backing plate.

19. A shock absorber device according to claim 18 wherein the shock absorbing body is mounted on one side of the backing plate and an operatively horizontal flange projects from an opposite side of the backing plate, the flange being positioned to locate beneath a lower edge of the lowest carriage beam.

20. A forklift vehicle for use in handling pallets having upper and lower decks and at least one cross-bearer connected between the decks, the forklift vehicle comprising:

a post structure, a carriage structure moveable up and down the post structure, the carriage structure including vertically spaced, horizontally extending carriage beams, transversely spaced forks supported by the carriage structure, each fork having an upright portion and forwardly extending tine, the tines being arranged to enter between the upper and lower decks of a pallet, and a shock absorber device including a shock absorber in the form of a hollow, elongate D-rubber which is located between the forks and which is carried by the carriage structure, the arrangement being such that the D-rubber extends horizontally in front of the lowest carriage beam, between the forks, in such a position as to impact upon an internal cross-bearer of the pallet and also upon the upper deck of the pallet when the forklift vehicle is driven towards the pallet.

21. A forklift vehicle according to claim 20 and comprising a backing plate on which the D-rubber is mounted, the backing plate being connected to and supported only by the lowest of the carriage beams.

22. A forklift vehicle according to claim 20 wherein the D-rubber comprises a series of D-section, hollow rubber segments arranged end to end with one another to form the full length of the D-rubber.

23. A forklift vehicle according to claim 22 wherein the rubber segments are replaceable independently of one another.

24. A forklift vehicle according to claim 23 wherein some of the segments are made of elastomeric material which is of different stiffness to the elastomeric material of which other segments are made.

25. A forklift vehicle according to claim 21 wherein the D-rubber is mounted on a bar which passes through the hollow of the D-rubber and which is connected to the backing plate.

* * * * *